United States Patent [19]

Takach et al.

[11] Patent Number: 4,638,177

[45] Date of Patent: Jan. 20, 1987

[54] ROTATING FLUX TRANSFORMER

[75] Inventors: David S. Takach, Brentwood, Mo.; Rao L. Boggavarapu, Monroeville, Pa.; Ram R. P. Sinha, Watkinsville, Ga.

[73] Assignee: Westinghouse Electric Corp., Pittsburgh, Pa.

[21] Appl. No.: 798,259

[22] Filed: Nov. 14, 1985

[51] Int. Cl.[4] ..... H01H 85/02

[52] U.S. Cl. ..... 307/83; 307/412; 307/416; 336/229; 336/5; 336/10; 336/12; 376/133; 376/143; 323/250; 323/329; 363/154

[58] Field of Search ..... 307/7, 83, 412, 414, 307/415, 416; 336/220, 221, 225, 229, 206, 208, 5, 10, 12; 376/128, 140, 135, 142, 134, 146, 136, 132, 133, 130, 143; 363/154; 323/215, 250, 251, 301, 331, 332, 355, 305, 328, 329

[56] References Cited

U.S. PATENT DOCUMENTS

| | | | |
|---|---|---|---|
| 2,975,357 | 3/1961 | Manning | 336/12 X |
| 3,004,171 | 10/1961 | Lipkin | 307/416 |
| 3,671,901 | 6/1972 | Lys | 336/5 |
| 4,087,322 | 5/1978 | Marcus | 376/142 X |
| 4,129,820 | 12/1978 | Brock | 336/12 X |
| 4,205,288 | 5/1980 | Lin et al. | 336/5 |
| 4,292,124 | 9/1981 | Fisch | 376/132 |
| 4,292,125 | 9/1981 | Bers | 376/133 X |
| 4,302,284 | 11/1981 | Ohkawa | 376/133 |
| 4,551,700 | 11/1985 | Waldemar | 336/229 X |
| 4,595,843 | 6/1986 | Del Vecchio et al. | 336/229 X |

*Primary Examiner*—Bernard Roskoski
*Assistant Examiner*—Shik Luen Paul Ip
*Attorney, Agent, or Firm*—D. R. Lackey

[57] ABSTRACT

A rotating flux transformer which includes a magnetic core having poloidal primary and secondary windings and toroidal primary and secondary windings. Quadrature flux is produced in the magnetic core by connecting one end of the poloidal primary winding to the center of the toroidal primary winding. The quadrature flux combines vectorially to produce a rotating induction vector in the magnetic core.

4 Claims, 10 Drawing Figures

ROTATING FLUX TRANSFORMER

BACKGROUND OF THE INVENTION

1. Field of the Invention:

The invention relates in general to electrical transformers, and more specifically to rotating flux transformers.

2. Description of the Prior Art:

Co-pending application Ser. No. 607,852, filed May 7, 1984 entitled "Low Core Loss Rotating Flux Transformer", which is assigned to the same assignee as the present application, discloses a transformer construction in which a rotating induction vector is achieved throughout all of the magnetic core material. By adjusting the excitation current to saturate the magnetic core, i.e., provide a saturated rotating induction vector, the hysteresis core loss is eliminated. Also, since magnetic domains disappear at saturation, eddy current losses influenced by magnetic domain size are reduced. This is an especially significant reduction in losses for amorphous alloys, because of their large domains.

To obtain a rotating induction vector, two magnetic fluxes approximately 90° out of phase must be generated in the magnetic core. The co-pending application discloses obtaining the desired 90° phase shift from a single-phase source via reactive elements; or, from a three-phase source by vectorially combining two phases of proper polarity to obtain a voltage 90° at a phase with the remaining phase voltage. Thus, in a single-phase embodiment, considerable cost would be involved in the reactive components associated with the phase shift function. In a three-phase embodiment three different vector combinations each involving a different pair of phases would be required.

Co-pending application Ser. No. 607,852 is hereby incorporated into the specification of the present application by reference.

SUMMARY OF THE INVENTION

Briefly, the present invention is a new and improved rotating flux transformer having a magnetic core with both poloidal and toroidal primary windings. Quadrature flux is generated in the magnetic core more directly than by utilizing the vector combination of different phases, and less costly than the utilization of reactive phase shift components.

More specifically, primary toroidal and poloidal windings are T-connected, with one end of the poloidal primary winding being connected to the mid-point of the toroidal primary winding. A three-phase source of alternating potential is connected to the remaining end of the poloidal primary winding and to both ends of the toroidal winding. The poloidal primary winding is constructed to provide a voltage drop of 0.866 $V_L$ where $V_L$ is the primary line-to-line voltage. Since the line-to-line primary voltage is applied across the complete toroidal primary winding, the number of turns in the poloidal primary winding is equal to 0.866 times the number of turns in the toroidal primary winding. The neutral point is located on the poloidal primary winding at a point which is 0.288 $V_L$ from the end of the poloidal primary winding which is connected to the toroidal primary winding. Poloidal and toroidal secondary windings are also provided, which may be connected to provide a three-phase output, a two-phase output, or a single-phase output, as desired.

BRIEF DESCRIPTION OF THE DRAWINGS

The invention may be better understood, and further advantages and uses thereof more readily apparent, when considered in view of the following detailed description of exemplary embodiments taken with the accompanying drawings in which.

DESCRIPTION OF THE PREFERRED EMBODIMENTS

Figure 1:
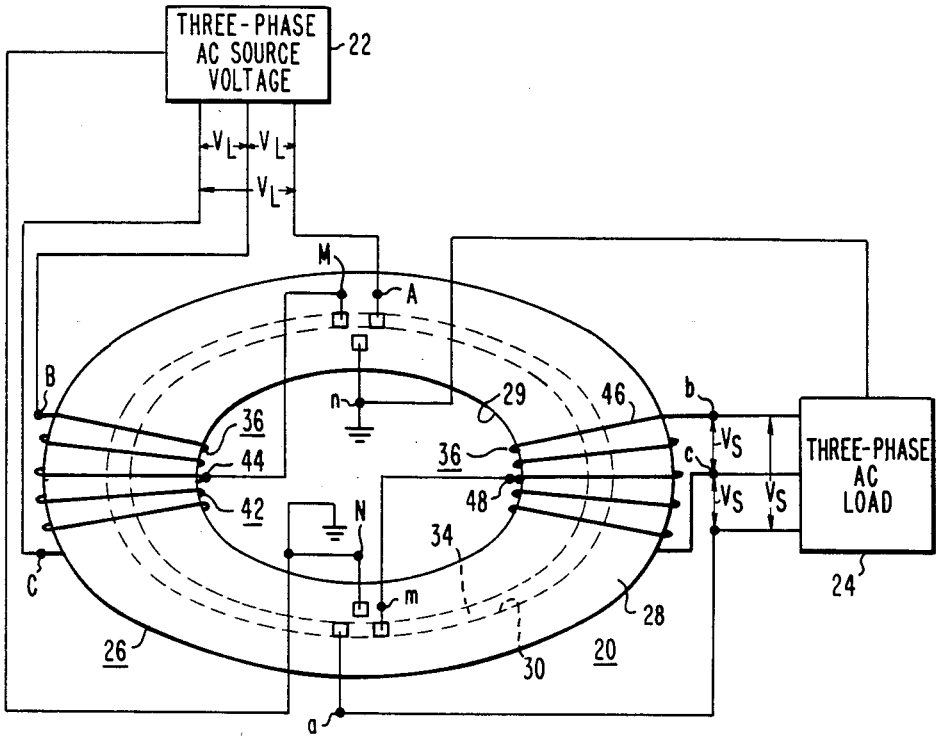
FIG. 1 is a perspective view of a three-phase to three-phase embodiment of a rotating flux transformer constructed according to the teachings of the invention.
Figure 2:
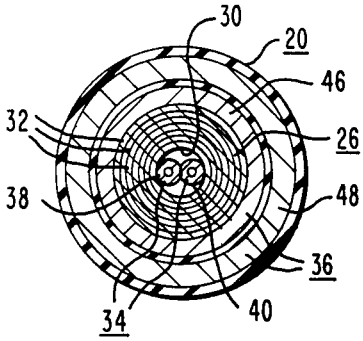
FIG. 2 is a sectional view which illustrates how the core-coil assembly of the transformer shown in FIG. 1 may be constructed.

Referring now to the drawings, and to FIG. 1 in particular, there is shown a rotating flux transformer 20 constructed according to the teachings of a first embodiment of the invention, in which transformer 20 couples a three-phase source 22 of alternating potential to a three-phase load circuit 24. The three-phase source 22 of alternating potential has a line-to-line voltage $V_L$, and the three-phase output voltage has a line-to-line voltage $V_S$. Transformer 20 includes a magnetic core 26 which is in the form of a continuous closed loop having an outer surface 28, an opening or window 29, and an axially extending opening or cavity 30. Magnetic core 26 is preferably constructed of a magnetic material which has a relatively high resistivity, in order to produce a transformer having the lowest possible core loss, such as an amorphous alloy, but other magnetic materials may be used. FIG. 2 is a cross-sectional view of an arrangement which may be used for constructing transformer 20, wherein magnetic core 26 includes a plurality of concentric metallic laminations 32, such as may be provided by spirally winding a metallic magnetic strip about an insulative winding tube which forms cavity 30. A strip of amorphous metal four to six inches wide, for example, having a nominal thickness of about 1 mil would be excellent for forming magnetic core 26.

Figure 3:
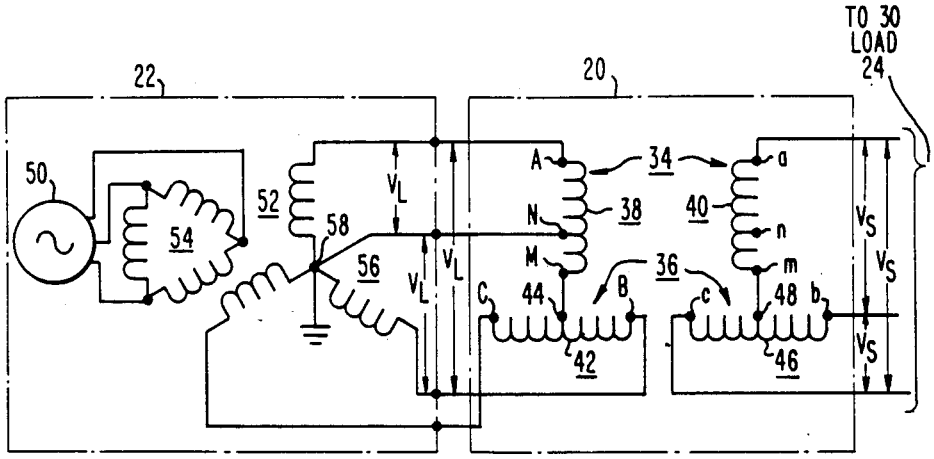
FIG. 3 is a schematic diagram of the transformer shown in FIG. 1.

Transformer 20 includes poloidal windings 34 disposed within opening or cavity 30 of magnetic core 26, and toroidal windings 36 wound about the outer surface 28 of magnetic core 26. The poloidal and toroidal windings are not in inductive relation with one another, as the magnetic flux generated by the poloidal windings does not link the toroidal windings, and vice versa. As shown more clearly in FIG. 2, the poloidal windings include a primary winding 38 and a secondary winding 40. While only one turn is illustrated for each winding, it is to be understood that these windings may have any desired number of turns. As shown in FIG. 3, poloidal primary winding 38 has first and second ends A and M and a tap N. Poloidal secondary winding 40 has first and second ends a and m and a tap n. As will be hereinafter explained, poloidal primary winding 38 is constructed to provide a voltage drop $V_{AM}$ of about 0.866 $V_L$, and the voltage $V_{am}$ across the poloidal secondary winding 40 is about 0.866 $V_S$. Tap N on the poloidal primary winding 38 is located such that that voltage $V_{NM}$ from tap N to end M is about 0.288 $V_L$. Tap n on the poloidal secondary winding 40 is located such that the voltage $V_{nm}$ from tap n to end m is about 0.288 $V_S$.

The toroidal windings 36 include a primary winding 42 having ends B and C, a center tap 44, and a secondary winding 46 having ends b and c and a center tap 48. Toroidal primary and secondary windings 42 and 46 are illustrated as being spaced apart on magnetic core 26 in order to simplify the drawing. In actual practice they would be concentrically disposed as illustrated in FIG. 2, or interleaved.

In the connection of the electrical windings of transformer 20, the poloidal primary winding 38 has its end M connected to the center tap 44 of the toroidal primary winding 42, and the poloidal secondary winding 40 has its end m connected to the center tap 48 of the toroidal secondary winding 46. The three-phase source voltage 22 has its output terminals connected to the reemaining end A of the primary poloidal winding 38, and to both ends B and C of the toroidal primary winding 42. The three-phase output voltage appears at end a of the poloidal secondary winding 40, and at ends b and c of the toroidal secondary winding 46.

As illustrated in the schematic diagram of FIG. 3, the three-phase source 22 of alternating potential may include a three-phase generator 50 and a step-down transformer 52. A Δ-wye transformer connection is shown for the primary and secondary windings 54 and 56, respectively, of transformer 52, merely for purposes of example. When the secondary winding of source 22 includes a neutral, such as the neutral 58, it is connected to tap N of the poloidal primary winding 38. Tap n of the poloidal secondary winding 40 is the neutral point of the three-phase secondary or output voltage.

Figure 4:
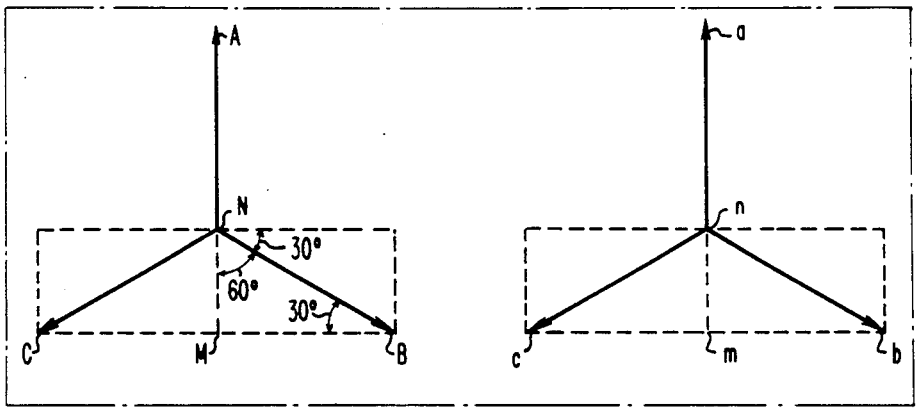
FIG. 4 is a phasor diagram of the transformer shown in FIG. 1.

FIG. 4 is a phasor diagram which illustrates how the quadrature voltages and their associated magnetic fluxes are produced from the three-phase source 22. Voltage $V_{BC}$ is equal to the line-to-line source voltage $V_L$, and this establishes the volts per turn. Voltage $V_{BC}$ is also equal to the $\sqrt{3}\ V_{AN}$ and the voltage $V_{BM}$ to the center tap is $\sqrt{3/2}\ V_{AN}$. The location of the neutral terminal N is thus determined by:

$$V_{NM}=(V_{BC}/2)\tan 30,$$

or $V_{NM}=0.288\ V_{BC}$. Thus, the number of turns from tap N to end M of the poloidal primary winding 38 is equal to 0.288 times the number of turns in the toroidal primary winding 42.

The voltage $V_{AM}$ across the complete poloidal primary winding is equal to $V_{AN}+V_{NM}$. Since:

1. $V_{AN}=V_{BC}/\sqrt{3}$, and
2. $V_{NM}=0.288\ V_{BC}$, then
3. $V_{AM}=0.578\ V_{BC}+0.288\ V_{BC}$, or $0.866\ V_{BC}$ Thus, the number of turns in the poloidal primary winding 38 is equal to 0.866 times the number of turns in the toroidal primary winding 42. The same relationships are true for the secondary windings. The poloidal secondary winding 40 has 0.866 times the number of turns in the toroidal secondary winding 46, and the number of turns from end m to tap n is equal to 0.288 times the number of turns in the toroidal secondary winding 46.

Figure 5:
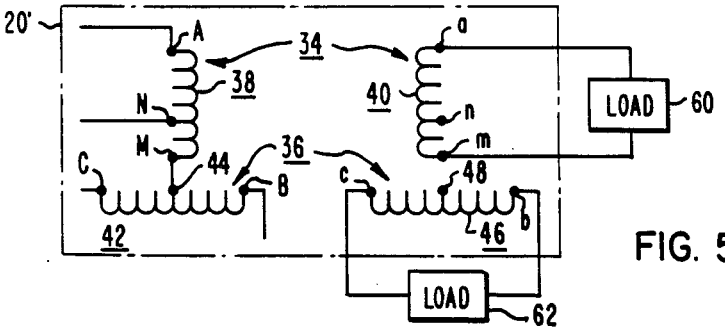
FIG. 5 is a schematic diagram illustrating how the transformer arrangement of FIG. 1 may be modified to provide a two-phase output.
Figure 6:
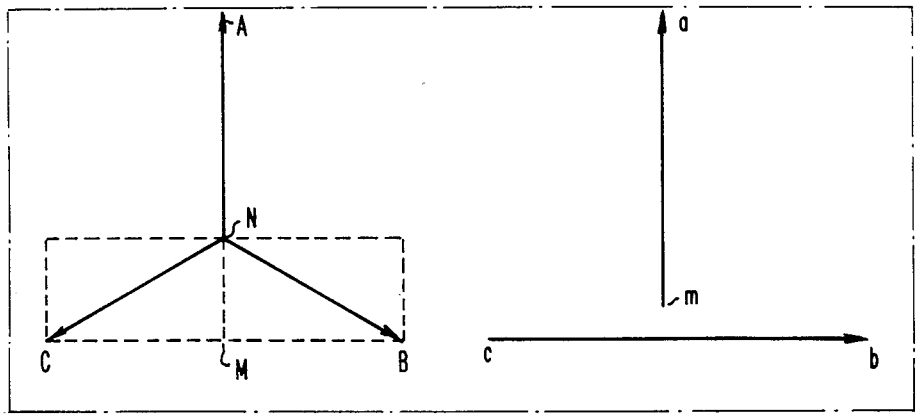
FIG. 6 is a phasor diagram of the two-phase embodiment shown in FIG. 5.

FIG. 5 is a schematic diagram which illustrates that by eliminating the connection between end m of the poloidal secondary winding 40 and the center tap 48 of the toroidal secondary winding 46, a three-phase to two-phase transformer 20' is provided. Windings 40 and 46 may be connected to a two-phase load, or to two separate loads 60 and 62. FIG. 6 is a phasor diagram of the FIG. 5 embodiment.

Figure 7:
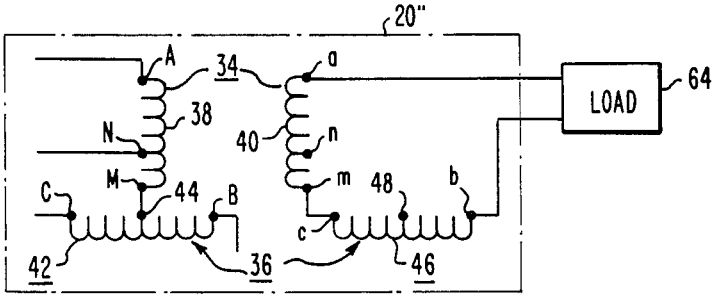
FIG. 7 is a schematic diagram illustrating how the transformer arrangement of FIG. 1 may be modified to provide a single-phase output.
Figure 8:
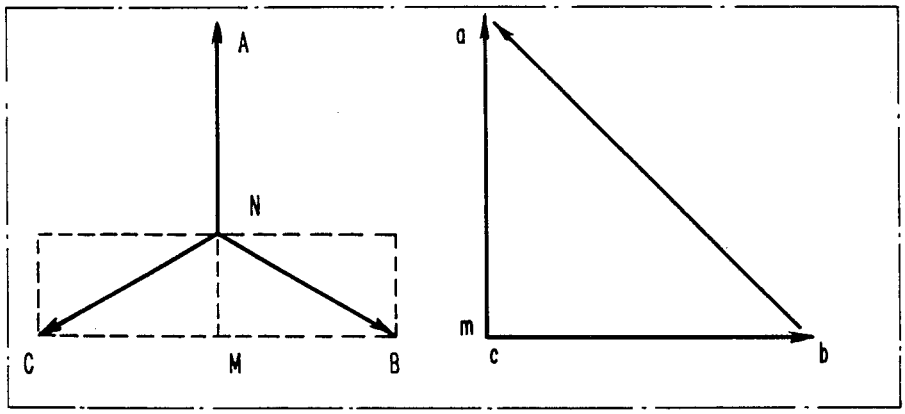
FIG. 8 is a phasor diagram of the single-phase embodiment shown in FIG. 7.

FIG. 7 is a schematic diagram which illustrates that when end m of the poloidal secondary winding 40 is connected to end c of the toroidal secondary winding 46, a three-phase to single-phase transformer 20'' is provided. The single-phase voltage $V_{ab}$, which is equal to the vector sum of voltages $V_{am}$ and $V_{bc}$, may be applied to a single-phase load 64. FIG. 8 is a phasor diagram of the FIG. 7 embodiment.

Figure 9:
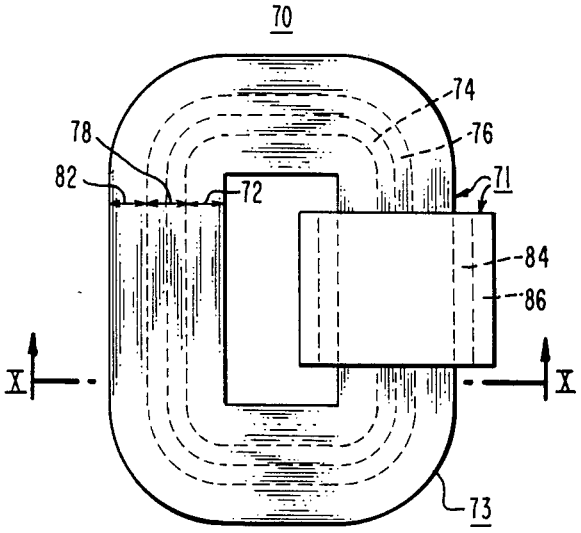
FIG. 9 is an elevational view of a rotating flux transformer constructed to vertify the principles of the invention.
Figure 10:
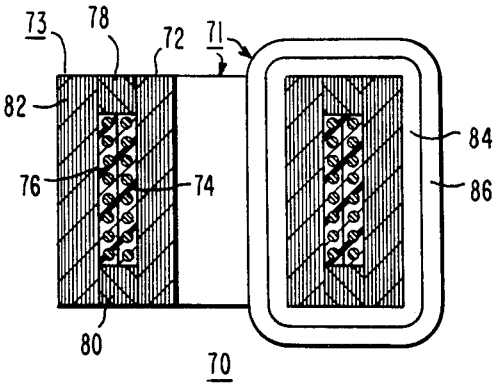
FIG. 10 is a cross sectional view of the transformer shown in FIG. 9, taken between and in the direction of arrows X—X.

To verify that the disclosed transformer construction would actually function as a transformer, a transformer 70 having a core-coil assembly 71 shown in FIGS. 9 and 10 was constructed. FIG. 9 is an elevational view of transformer 70 and FIG. 10 is a cross sectional view of transformer 70 taken between and in the direction of arrows X–X in FIG. 9. Core-coil assembly 71 includes a magnetic core 73. Magnetic core 73 was constructed by winding a strip of magnetic metallic material to provide a core loop having a predetermined number of lamination turns, and the outer wraps or lamination turns were removed to provide a first core section 72. A low voltage or secondary teaser winding 74 was then wound about the first core section 72. A high voltage or primary teaser winding 76 was then wound about the low voltage teaser winding 74. Small core sections 78 and 80 were then wound at the ends of windings 74 and 76, using strips of magnetic metallic material of appropriate width dimensions. Then, certain of the outer laminations which were originally removed from the core loop were replaced to form core section 82. Thus, windings 76 and 74 correspond to the poloidal primary and secondary windings 38 and 40, respectively, of the FIG. 1 embodiment. Main secondary and primary windings 84 and 86, respectively, were then wound concentrically about one of the legs of magnetic core 73. Open circuit and load tests were then performed on the transformer 70 and the measured voltage ratios for the embodiments of FIGS. 1 and 3 were found to be close to the calculated ratios for different voltage inputs. Nine mil grain oriented electrical steel was used to construct transformer 70, which led to higher than normal exciting current values due to the flux crossing the laminations at the core ends. The exciting current would be lower with the use of non-oriented electrical steel, such as the steel used for motor laminations, or by using amorphous alloys.

In summary, there has been disclosed a new and improved rotating flux transformer which obtains two 90° phase shifted magnetic fluxes without the use of auxiliary reactive components, and without requiring three vector combinations of interconnected phase voltages. The invention achieves the desired phase shift with the use of poloidal primary and secondary windings, each having a tap which forms the neutral point of a three-phase configuration, and with center tapped toroidal primary and secondary windings. One end of the primary poloidal winding is connected to the center tap of the toroidal primary winding. A three-phase source of alternating potential is connected to the remaining end of the poloidal primary winding, and to both ends of the toroidal primary winding. A three-phase output, a two-phase output, or a single-phase output can be provided by simple interconnections between the poloidal and toroidal secondary windings.

We claim as our invention:

1. A rotating flux transformer comprising:

a magnetic core defining a closed loop having an outer surface disposed about a longitudinal axis, said magnetic core further defining an axially extending opening, a toroidal primary winding disposed about the outer surface of said magnetic core, said toroidal primary winding having first and second ends and a center tap, a poloidal primary winding disposed through the axially extending opening of said magnetic core, said poloidal primary winding having first and second ends and a tap N, said toroidal and poloidal primary windings being T-connected, with the first end of said poloidal primary winding being connected to the center tap of said toroidal primary winding, a three-phase source of alternating potential having a line-to-line voltage $V_L$ and first, second and third output terminals respectively connected to the second end of said poloidal primary winding and to the first and second ends of said toroidal primary winding, and at least one secondary winding disposed in inductive relation with a selected one of said primary windings, said poloidal primary winding being constructed to have about 0.866 times the number of turns of the toroidal primary winding, and about 0.288 times the number of turns of the toroidal winding from the tap N to the center tap of the toroidal primary winding.

2. The rotating flux transformer of claim 1 wherein the at least one secondary winding is a toroidal winding disposed in inductive relation with the toroidal primary winding, said toroidal secondary winding having first and second ends and a center tap, and including a poloidal secondary winding disposed in inductive relation with the poloidal primary winding, said poloidal secondary winding having first and second ends and a tap n, with the first end of said poloidal secondary winding being connected to the center tap of said toroidal secondary winding, said toroidal and poloidal secondary windings providing a three-phase output voltage having a line-to-line voltage of $V_S$ at the second end of said poloidal secondary winding and the first and second ends of said toroidal secondary winding, with the poloidal secondary winding being constructed to have about 0.866 times the number of turns in the toroidal secondary winding, and with the number of turns from the tap n to the center tap of the toroidal secondary winding being equal to about 0.288 times the number of turns of the toroidal secondary winding.

3. The rotating flux transformer of claim 1 wherein the at least one secondary winding is a toroidal winding disposed in inductive relation with the toroidal primary winding, and including a poloidal secondary winding disposed in inductive relation with the poloidal primary winding, with said toroidal and poloidal secondary windings providing first and second voltages which are about 90° out of phase.

4. The rotating flux transformer of claim 1 wherein the at least one secondary winding is a toroidal winding disposed in inductive relation with the toroidal winding, said toroidal secondary winding having first and second ends, and including a poloidal secondary winding disposed in inductive relation with the poloidal primary winding, said poloidal secondary winding having first and second ends, said toroidal and poloidal secondary windings having selected ends connected together to provide a single-phase output voltage across their remaining ends which is the vector sum of the individual voltages across the poloidal and toroidal secondary windings.

* * * * *